US006349449B1

(12) United States Patent
Kuehl

(10) Patent No.: US 6,349,449 B1
(45) Date of Patent: Feb. 26, 2002

(54) HINGE FOR ACCOMMODATING A PIVOTING COMPONENT

(75) Inventor: Hans Kuehl, Plochingen (DE)

(73) Assignee: DaimlerChyrsler AG, Stuttgart (DE)

( * ) Notice: Subject to any disclaimer, the term of this patent is extended or adjusted under 35 U.S.C. 154(b) by 0 days.

(21) Appl. No.: 09/446,798

(22) PCT Filed: Jun. 16, 1998

(86) PCT No.: PCT/EP98/03611

§ 371 Date: May 3, 2000

§ 102(e) Date: May 3, 2000

(87) PCT Pub. No.: WO98/59139

PCT Pub. Date: Dec. 30, 1998

(30) Foreign Application Priority Data

Jun. 23, 1997 (DE) ..... 197 26 536

(51) Int. Cl.[7] ..... E05C 17/64
(52) U.S. Cl. ..... 16/342; 16/332
(58) Field of Search ..... 16/342, 337, 341, 16/343, 344, 345

(56) References Cited

U.S. PATENT DOCUMENTS 2,458,707 A * 1/1949 Jacobs ..... 16/342
4,734,955 A * 4/1988 Conor ..... 16/332
5,500,982 A * 3/1996 Hosoi ..... 16/297
5,761,769 A * 6/1998 Bruckner et al. ..... 16/342

FOREIGN PATENT DOCUMENTS

| | | |
|---|---|---|
| DE | 44 06 824 A1 | 9/1995 |
| DE | 196 00 063 A1 | 5/1997 |
| DE | 196 25 556 A1 | 1/1998 |
| DE | 196 25 557 A1 | 1/1998 |

* cited by examiner

*Primary Examiner*—Anthony Knight
*Assistant Examiner*—Mark Williams
(74) *Attorney, Agent, or Firm*—Crowell & Moring LLP

(57) ABSTRACT

In order to achieve the situation where a pivotably mounted structural part, under the action of an adjusting force, is made to move indeed automatically but merely with braking and damping action, and thus at a reduced speed and with reduced kinetic energy, provision is made for the hinge which mounts the structural part to be equipped with a pivot brake, of which the braking force applied over the pivoting distance is smaller than the adjusting force and is adapted to the progression of the adjusting force over the pivoting distance. In selected regions, the braking force of the pivot brake may be greater than the adjusting force, in order to retain the structural part in these regions. The braking work performed by the pivot brake is advantageously calculated so as to absorb 20% to 25% of the adjusting work performed by the adjusting force.

23 Claims, 3 Drawing Sheets

HINGE FOR ACCOMMODATING A PIVOTING COMPONENT

BACKGROUND AND SUMMARY OF THE INVENTION

This application claims the priority of German application 197 26 536.7, filed in Germany on Jun. 23, 1997, and International PCT Application PCT/EP98/03611 filed in the European Patent Office on Jun. 16, 1998, the disclosures of which are expressly incorporated by reference herein.

The invention relates to a hinge for the pivotable mounting of a structural part on which there acts an adjusting force which causes said structural part to pivot, and having a pivot brake which inhibits said pivoting and is in the form of interacting cylinder wedge surfaces on the hinge pin and on at least one of the hinge plates.

Within the context of the application, hinge is intended to mean an articulated connection with at least one axis which has a shaft in the form of a hinge pin and a hub in the form of a pivotable hinge plate. Such an articulated connection may also be expressed, for example, as a door hinge or piano hinge. The hinge may also have two parallel axes between which a hinge bridge is arranged. The hinge serves for the pivotable mounting of a structural part. This means that the mounting element of the hinge is arranged in a usually fixed manner. However, this does not prevent said mounting element, on its part, from being mounted pivotably in a further articulated connection, for example the abovementioned hinge bridge about the abovementioned second axis.

Pivot brake is intended to mean an inhibiting device which sets a certain resistance, in other words an opposing force against the pivoting of the pivotable mounted structural part under the action of an adjusting force, which opposing force is usually smaller than the adjusting force. As long as the adjusting force remains smaller than the opposing force, the inhibiting device acts as a pivot stop and prevents the structural part from pivoting under the action of the adjusting force.

The adjusting force acting on the pivotably mounted structural part may be of any desired nature. It may be formed by the gravitational force, for example, on structural parts that can be pivoted about a horizontal axis, such as swing-action covers or swing-action seats; it may be applied by an energy store, such as a spring, or it may be exerted spontaneously, for example by a gust of wind acting on a door.

Cylinder wedge surfaces are intended to mean cams which, on mutually facing surfaces of the hinge pin and of the hinge plate which are equiaxial with the axis of the hinge, slope gradually upwards in wedge form from an imaginary cylinder surface in each case and then drop down sharply again onto the cylinder surface, it being the case that the cams are arranged on an inner surface of one of the structural parts and on an outer surface of the other structural part and the directions of upward slope of the cams oppose one another, and it being the case that provided between the cylinder wedge surfaces in a joining position is a joining gap which is smaller than the height of the cams beyond their respective reference cylinder surface.

DE 44 06 824 C describes a hinge with pivot stop which prevents a part which is mounted in a hinge bolt from being pivoted under the action of adjusting forces, which are not intended to cause pivoting. This achieves the situation where, for example, a door has a self-securing action in all pivot positions of its open-angle range. In this case, the braking force of the pivot brake thus always exceeds the adjusting force, which is not intended to cause pivoting.

However, there are a number of known application cases in which structural parts are intended to be pivotable with respect to one another by virtue of adjusting forces acting on them, although the intention is for this pivoting ability to be inhibited, braked or damped to a more or less pronounced extent and/or merely over part of the pivoting range. In many cases, furthermore, it is advantageous if the braking action may be calculated so as to prevent pivoting by adjusting forces which are below a threshold value. Examples of this are engine bonnets or boot lids, which have to be capable of being opened or closed by hand, but which are not intended to bang shut from the open position under the action of gravitational force and are not intended to bang shut without braking once they have been lowered from the open position. Another example is constituted by vehicle doors which, depending on their position and depending on the inclination of the vehicle, are subjected, by the gravitational force or a gust of wind, to very different moments, which are intended to be compensated for at least to the extent where a door is retained in the open position and/or does not unintentionally pivot out of this position with accelerating action without braking.

A further example is constituted by swing-action seats in public transport or in fixed seating arrangements, said swing-action seats usually being guided into the swung-up position by spring force. It is frequently desirable for said seats to be retained in a swung-down position, in order that they do not swing upwards when one stands up for a brief period of time. The intention is for the automatic swing-up operation to be initiated by a brief lifting action. Furthermore, it is not intended for such seats to be accelerated to a pronounced extent under the action of the spring force, in order that they do not strike against their top abutment. Their swing-up operation is thus intended to take place with braked action at least in the end region of their pivoting movement.

Accordingly, the object of the invention was to specify, for a hinge having a pivot brake with cylinder wedge surfaces, a rule for calculating the braking action and embodiments which can best fulfil these requirements. The invention achieves this object in that the progression of the braking moment of the pivot brake is adapted to the progression of adjusting forces acting on the structural part over the pivot angle to the effect that the adjusting force is opposed by braking force which is smaller than the adjusting force at least over a considerable part of the pivot angle.

This achieves the situation where it is only the difference between the adjusting force and the braking force which acts on the structural part. The structural part can thus be pivoted by the adjusting force over a considerable part of its pivot angle, but only in a braked, inhibited and slowed-down manner. It is thus not a more or less arbitrary progression of the braking moment of the pivot brake between assumed start and end values which is selected, but rather a progression which is adapted to the progression of the adjusting forces acting on the pivotable structural part and is determined by parameters such as mass of the pivotable structural part, swivel arm of the center of gravity of the structural part, pivot angle, inclination of the pivot axis in space and the like. Since these parameters may differ greatly from case to case, the progression of the adjusting forces and the sought-after progression of the pivoting movement have to be determined before the progression of the braking moment is established.

In one or more narrow regions of the pivot angle of the structural part it is contemplated, for the braking force of the pivot brake to exceed the adjusting force, with the result that, rather than being pivoted by the adjusting force in these regions, the structural part is blocked. These regions are usually the start or end regions of the pivot angle or, in general terms, positions in which the structural part is to be retained automatically.

In many cases, it is also advantageous if, according to contemplated arrangement, the pivot brake does not set any braking force against the adjusting force in a region of the pivot angle. This relates, in particular, to a region upstream of the start or end point of a pivot angle, which is intended to be reliably reached and retained by means of the adjusting force.

This can be achieved by corresponding dimensioning, or by appropriate angle positioning, of the wedge surfaces. For this purpose, according to contemplated arrangements, the pivot brake may be provided with a plurality of wedge surfaces which take effect in the different regions of the pivot angle and, depending on the sought-after functioning, may be provided with the same direction of slope or with opposite directions of slope. In the former case, the wedge-surface pairings take effect one after the other and the pivot brake exerts a braking force over a large pivot range. In the second case, the wedge-surface pairings come into effect depending on the pivoting direction, as a result of which the pivot brake exerts increasing braking force in the two pivoting directions. The wedge surfaces may be provided with the same or different slopes, with the result that, depending on the pivoting direction, the pivot brake may be imparted different braking action or braking action which increases progressively or degressively with the pivot angle.

It has been found to be sufficient in most cases if the pivot brake uses up at least 20% of the adjusting work performed by the adjusting force, that is to say of the product of adjusting force and pivoting distance, by braking work, that is to say by the product of braking force and pivoting distance, i.e. if the pivot brake converts this into heat energy in order to achieve sufficient braking of the movement of the respectively pivot-braked structural part.

Precisely angled adjustment of the wedge surfaces is virtually always necessary in order to allow the braking action of the pivot brake to set in, and increase, at the correct pivot angle. This is made possible by the arrangements (i) wherein the hinge pin has means for adjusting its angle position, and/or (ii) wherein the hinge pin in a second axial region, and the hinge-pin-securing hinge plate have conical fitting surfaces which can be pressed one inside the other, and/or (iii) wherein the hinge pin, in a second axial region and the hinge-pin-securing hinge plate have fitting surfaces with interengaging toothing arrangements.

Other objects, advantages and novel features of the present invention will become apparent from the following detailed description of the invention when considered in conjunction with the accompanying drawings.

DETAILED DESCRIPTION OF THE DRAWINGS

An essential design element of the present invention is constituted by the wedge profiles, the design and functioning of which will be described first of all.

Figure 1:
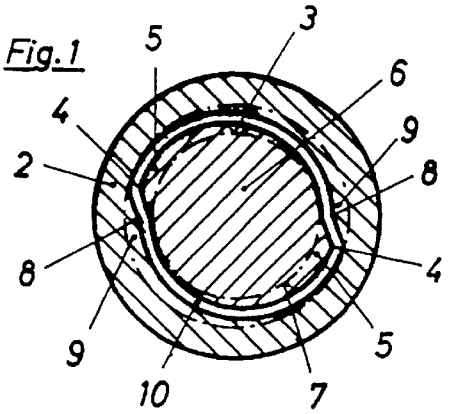
FIGS. 1 and 2 are sectional views which show the principle of the wedge profiles with the pivot brake in two different positions.

As can be seen from FIG. 1, a hinge 1 has a hinge plate 2 which acts as a hub and, on its inner surface, has a plurality of, in the illustrated embodiment two, cams 9 which are offset with respect to one another by 180° in each case, slope gradually upwards in wedge form, from an imaginary cylinder surface, inwards in the clockwise direction as far as a line 8 and then drop down sharply again to the cylinder surface. Accordingly, the hinge pin 6, which acts as a shaft, has two cams 5 which are offset with respect to one another by 180° in each case, slope gradually upwards in wedge form, from an imaginary cylinder surface 7, in the anticlockwise direction as far as a line 4 and then drop down sharply again to the cylinder surface. In a joining position, the rear surfaces of the cams 5 and 9 have a joining gap 10 by means of which the hinge plate 2 and hinge pin 6 can be inserted one into the other. In each case one rear surface of a cam 9 of the hub 2 and of a cam 5 of the shaft 6 form a coordinated wedge-surface pair. It is possible for a plurality of such wedge-surface pairs, which take effect synchronously, to be arranged in a rotary gap—these are referred to hereinbelow as a wedge-surface pairing 11. Accordingly, a wedge-surface pairing 11 comprises at least one wedge-surface pair, but may also have a plurality of these, two according to FIGS. 1 and 2 but also three and, expediently in technical terms, up to six wedge-surface pairs.

The wedge-surface pairings 11 form together with the parts bearing them, the hinge plate 2 and the hinge pin 6, a pivot brake 12.

Figure 2:
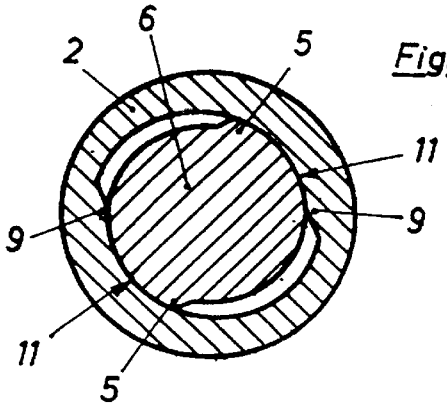

The two wedge-surface pairings 11 of FIGS. 1 and 2 have an operating range of approximately 120°. After passing through an angle of rotation of approximately 10° to 150°, they close the joining gap 10 and then pass into frictional engagement with one another. This frictional engagement, and thus the braking action, increases to a maximum in the case of further rotation, with increasing surface pressure. Since the contact surfaces of the rear sides of the cams 5 and 9 become shorter in this case, the braking force then decreases, despite increasing surface pressure, with the result that it is possible to utilize an angle range of approximately 120° for the braking action.

With the loading which occurs, the parts of such hinges usually consist of steel. In order to reduce the wear of the parts subjected to dry friction under high surface pressure, at least the frictional surfaces are advantageously hardened. It is possible to avoid straightforward linear contact of the wedge-surface pairings 11 being subjected to wear in that the upward slope of the wedge surfaces follows a logarithmic spiral.

As has already been mentioned, it is also possible for more than two wedge-surface pairings 11 to be distributed around the joining gap 10, these pairings taking effect synchronously and then having a correspondingly smaller operating range. It is likewise possible for at least two wedge-surface pairings 11 to be arranged one behind the other, of which first of all one takes effect and, once the latter has exceeded its maximum braking action, the second takes effect.

By virtue of a correspondingly large joining gap 10, it is also possible for wedge-profile pairings 11 to be provided with an initial idling region, in which case they only pass into frictional engagement, and produce a braking action, once they have passed through the same.

In FIGS. 1 and 2, for the sake of clarity, the heights of the cams 5, 9 are illustrated in a vastly exaggerated manner. The slope of the cams depends, in particular, on the braking action which they are intended to produce and on their number and, in most application cases, is between 1:10 and 1:100. The cams 5, 9 are distributed at regular intervals around the circumference of the joining gap 10. Two wedge-surface pairings 11 which take effect one after the other are used, in particular, when a large pivot angle of up to 180° is to be achieved. Otherwise, three wedge-surface pairings are preferred since these have the advantage of centering themselves.

FIG. 1 shows the wedge-surface pairings 11 in their joining position, in which they can be pushed one inside the other. FIG. 2 shows the position which they assume when in operation: the hinge pin 6 has rotated through approximately 90° in the clockwise direction during pivoting of the structural part borne by the hinge 1. In this case, the rear surfaces of the cams 5 and 9 have advanced towards one another, have then come into contact and are then slid on one another with increasing surface pressure. In this case, they have set frictional force against the rotary movement of the hinge pin 6 to an increasing extent and have also performed deformation work and have thus increasingly inhibited the pivoting movement and reduced, and damped, the speed of said pivoting movement.

This braking, inhibiting or damping action of the braking force in relation to the adjusting force is illustrated in the figures of the drawing in each case in the right-hand, even-numbered FIGS. 4 to 18. These figures illustrate force/pivot-angle diagrams which have the adjusting and braking forces plotted on the y-axis and the pivot angle plotted on the x-axis. The progression of the adjusting force is depicted in solid lines in each case, while the progression of the braking force is depicted by dashed lines.

Figure 3:
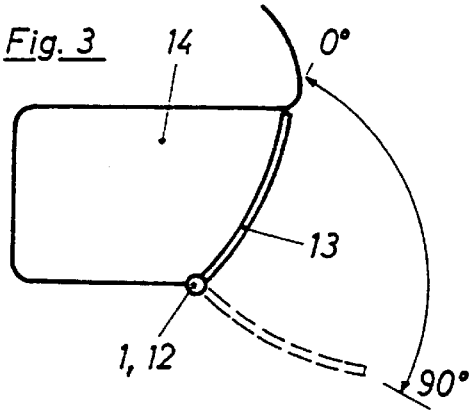
FIGS. 3 and 4 show the longitudinal section through a glove box of a vehicle with a swing-action glove-box cover together with a force/pivot-angle diagram of this object.
Figure 4:
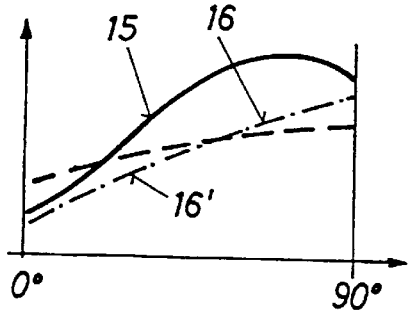

FIG. 3 shows a straightforward application case of a hinge 1 having such a pivot brake 12 on the swing-action cover 13 of a glove box 14 of a vehicle. The swing-action cover 13 is mounted in a single long hinge 1, or on two spaced-apart hinges 1, and can be swung downwards into the position depicted by dashed lines. Following release of the locking mechanism of the swing-action cover 13, said locking mechanism being conventional for such swing-action covers and therefore not being illustrated here, the swing-action cover drops downwards by a pivot angle of approximately 90° under the action of gravitational force, which in this case constitutes the adjusting force, and rests there on a stop (not illustrated). The basic progression of this adjusting force over the pivot angle is illustrated by the characteristic curve 15 in FIG. 4.

In order to avoid the situation where the swing-action cover 13 drops down too quickly and strikes hard against the stop, the hinge 1, or at least one of a plurality of hinges, is equipped with the pivot brake 12 according to the invention. By virtue of the configuration of its wedge profiles, said pivot brake is designed such that the progression of its braking force over the pivot angle basically corresponds to the characteristic curve 16 of FIG. 4. This characteristic curve 16 of the braking force may exceed the characteristic curve 15 of the adjusting force in the initial region of the pivoting distance from 0° with the result that it is not just the case that the swing-action cover is secured by its locking mechanism in this region; rather, rattling of the swing-action cover is also prevented by the additional retaining action by means of the pivot brake. For opening purposes, the swing-action cover 13 has to be drawn a short way downwards until the adjusting force 15 exceeds the braking force 16 and the swing-action cover moves downwards of its own accord. It is, of course, possible for the progression of the braking force of the pivot brake to be selected such that it also remains under the adjusting force in the initial region of the pivoting distance, with the result that the swing-action cover 13 starts moving immediately its locking mechanism has been disengaged. In this case, it would correspond to the progression of the characteristic curve 16'.

In the region in which the adjusting force exceeds the braking force, the swing-action cover 13 drops downwards under the action of the adjusting force, i.e. of the gravitational force. In this case, however, the swing-action cover is subjected not to the full extent of the adjusting force, but merely to the difference between the adjusting force 15 and braking force 16, with the result that the swing-action cover moves downwards in a braked and slowed-down manner.

Figure 5:
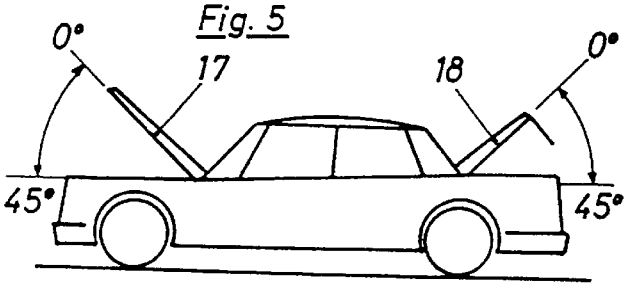
FIGS. 5 and 6 show a illustration of the pivotable engine hood and of a pivotable trunk lid of a vehicle together with a force/pivot-angle diagram of these objects.
Figure 6:
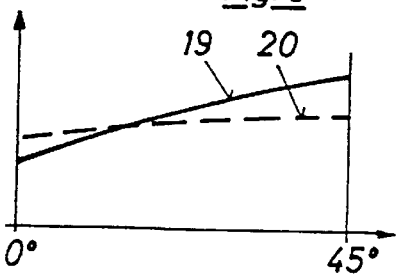

FIG. 5 illustrates a case in which the pivot brake 12 according to the invention is used to act on the engine hood 17 and on the trunk lid 18 of a vehicle. The weight of these swing-action covers mounted on hinges (not illustrated here) is usually at least more or less compensated for by a pneumatic spring or a steel spring. It should be assumed that the swing-action covers 17, 18 are subjected to adjusting forces over the pivoting range of approximately 45°, said adjusting forces also being represented by the characteristic curve 19 in FIG. 6. In order to prevent the swing-action covers 17, 18 from dropping down under the action of said adjusting force, the latter has set against it, by a pivot brake 12 installed in the hinges 1 of the swing-action covers, a braking force which, with its progression indicated by the characteristic curve 20, more or less compensates for the adjusting force over the pivoting range. Provision is also made here for the braking force to exceed the adjusting force in the open position of the swing-action covers, in order to retain the latter in said open position.

Figure 7:
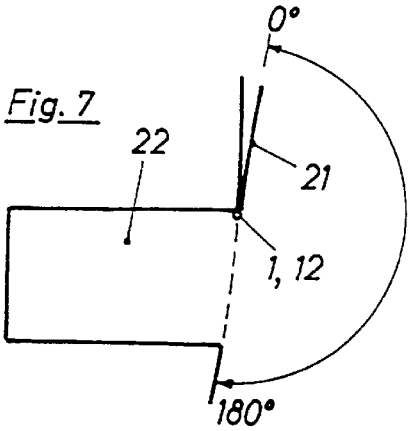
FIGS. 7 and 8 show the cross section through a stowage compartment of a motor vehicle with a swing-action stowage-compartment cover together with a force/pivot-angle diagram of said pivot-action stowage-compartment cover.

FIG. 7 shows a swing-action closure cover 21 on a stowage space 22 as is frequently installed beneath the floor of buses or coaches. This swing-action closure cover 21 is also mounted in hinges 1 which are equipped with pivot brakes 12. The swing-action cover 21, which can be pivoted through approximately 180°, is subjected to the action of gravitational force with the adjusting force, which is represented approximately by the characteristic curve 23 in FIG. 8.

Figure 8:
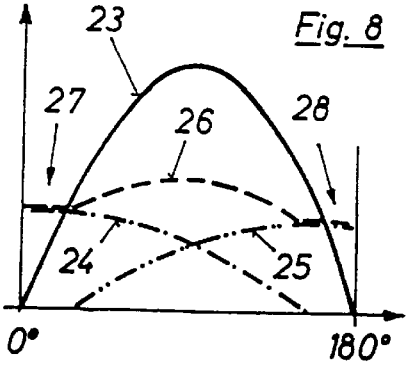

If the intention is for said adjusting force to be compensated for by the braking force completely in the open position (0° position) and closed position (180° position) of the swing-action cover 21, and partially in the region therebetween, it is possible to install, in at least one of the hinges 1, two pivot brakes 12 with their braking-force progressions in opposite directions and offset at an angle, as are indicated in FIG. 8 by the chain-dotted characteristic curve 24 and the chain-double dotted characteristic curve 25. The actions of these braking forces add up to give a braking force according to the dashed braking characteristic curve 26, which exceeds the adjusting force in the initial region 27 and in the end region 28 of the pivot angle of the swing-action cover 21 and opposes the same to a sufficient extent in the central region of said pivot angle.

Figure 9:
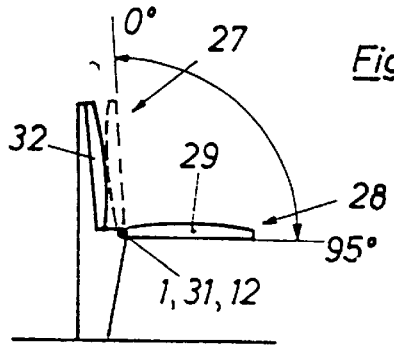
FIGS. 9 and 10 show the illustration of a swing-action seat together with a force/pivot-angle diagram of said swing-action seat.
Figure 10:
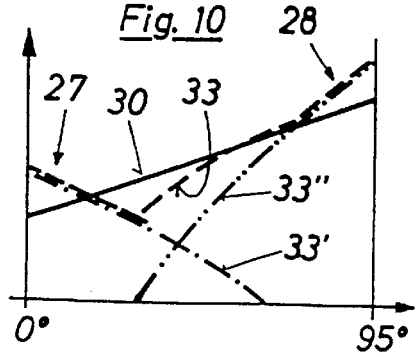

Wedge profiles with braking-force progressions in opposite directions are also used for the swing-action seat 29 of FIG. 9. The swing-action seat 29 is assumed to be pressed upwards towards the backrest 32, with a more or less linear torque, by the adjusting force of a spring (not illustrated) installed in the hinges 1 of the swing-action axis 31, said adjusting force being indicated by the characteristic curve 30 in FIG. 10. In order both to retain said seat in the swung-down position and to prevent it from rattling in the pivoted-up position, the progression of the braking force is selected in accordance with the dashed characteristic curve 33 such that the braking force exceeds the adjusting force in the initial and end regions 27, 28 of the pivoting range extending over approximately 95°. This progression of the braking force is achieved by superimposing two braking-force progressions 33' and 33", which can be illustrated by means of two pivot brakes with opposite directions of slope and with a steeper upward slope of the braking force 33" of the pivot brake which takes effect in the top end region 28.

The wedge-surface pairings with opposite directions of slope may be offset with respect to one another, for example, in the direction of the axis of the hinge. If, however, the pivot angle is only approximately 90°, it is also possible for the two wedge-surface pairings to be offset around the circumference. This is illustrated in more detail in FIG. 11.

Figure 12:
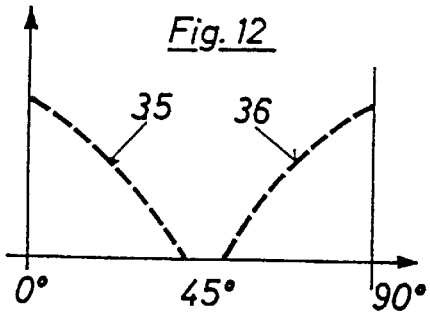

It shows the cross section through the double wedge-surface pairings 11' and 11", that is to say pairings which each have two cams 5 and 9, respectively, in the joining position, that is to say in the central region of the pivot angle of the swing-action seat 29 of FIG. 9. Starting from the axis-parallel lines 34 and 34', two wedge-surface pairs slope upwards in the clockwise direction, and two wedge-surface pairs slope upwards in the anticlockwise direction, over approximately 90° in each case. The tips 4, 8 of in each case two wedge-surface pairs coincide. This gives an apparently elliptical figure which nevertheless, for reasons already mentioned above, comprise four sections, which oppose one another in pairs, of a logarithmic spiral. Starting from the joining position in the region of 45°, said wedge-surface pairings 11' and 11" result, upon rotation in the clockwise direction or anticlockwise direction, in the increases 35 and 36, respectively, of the braking moment which are represented in FIG. 12. It goes without saying that these increases may be different, for example, as a result of different slopes and/or lengths of the wedge-surface pairs.

Figure 11:
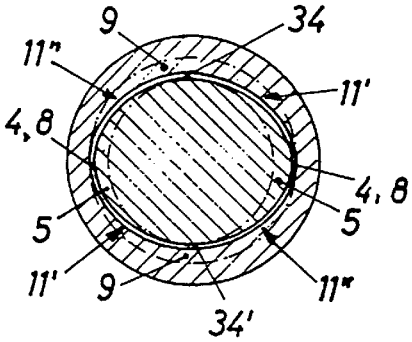
FIGS. 11 and 12 show an embodiment of the wedge profiles for the object from FIG. 9 together with a force/pivot-angle diagram of said embodiments.

When applied to the case of the swing-action seat 29 of FIGS. 9/10, it can be seen that the braking moments 35 and 36 of the embodiment of FIGS. 11/12 may readily be such that they exceed the torque 30 of the swing-action seat in the initial and end regions 27, 28 of its pivoting distance.

Figure 13:
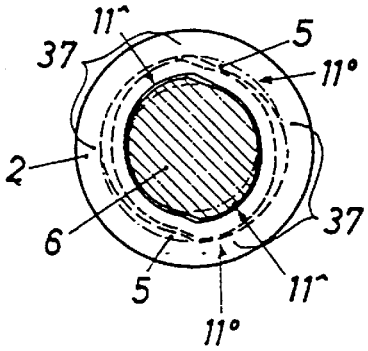
FIGS. 13 and 14 show an embodiment of the wedge profiles for particularly large pivot angles together with a force/pivot-angle diagram of said embodiment.

FIG. 13 shows an embodiment with which it is possible to achieve an increase in the braking force of wedge-surface pairings over a pivoting distance of 180° or more. Provided for this purpose are two wedge-surface pairings 11^ and 11° which are offset with respect to one another in the axial direction and each have two wedge-surface pairs, of which, for the sake of clarity, the wedge-surface pairing 11°, which is located to the rear in the viewing direction and is depicted by dashed lines, is illustrated with a larger diameter, although it may have the same diameter as the wedge-surface pairing 11^ which is located at the front. Starting from the joining position depicted, the wedge-surface pairing 11° has "idling regions" 37 of approximately 90° each, in which there is no upward slope of the cam 5 of the hub 2. Upon rotation of the shaft 6 in the anticlockwise direction, first of all it is just the rear surfaces of the wedge-surface pairing 11^ which pass into frictional engagement, which results in the increase in the braking force 38 which is illustrated by dashed lines in FIG. 14. When, following passage through an angle of rotation of approximately 90°, said wedge-surface pairing 11^ has reached the maximum of its braking force and the latter begins to decrease, the rear surfaces of the wedge-surface pairing 11° pass into frictional engagement and these, on their own, produce the braking force 38', which is represented by chain-dotted lines in FIG. 14. The braking forces 38 and 38' of the two wedge-surface pairings 11^ and 11° add up to give the line 39 which is depicted by solid lines in the diagram of FIG. 14.

Figure 14:
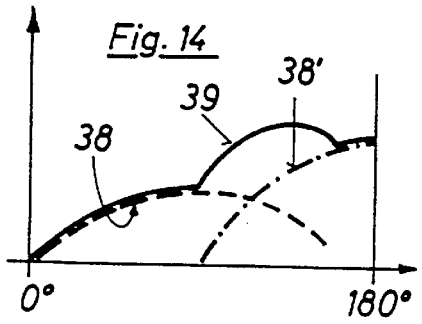

The increase in the braking force 38', which is produced by wedge-surface pairing 11° taking effect subsequently, is steeper as a result of the steeper upward slope of the wedge surfaces of said wedge-surface pairing, this resulting in the overall upwardly sloping progression of the braking force 39 as a whole, which can be seen from FIG. 14.

Figure 15:
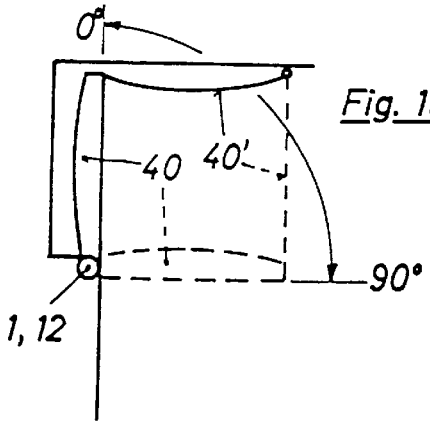
FIGS. 15 and 16 show the illustration of a swing-action bed, for example, in a motor vehicle together with a force/pivot-angle diagram of said bed.
Figure 16:
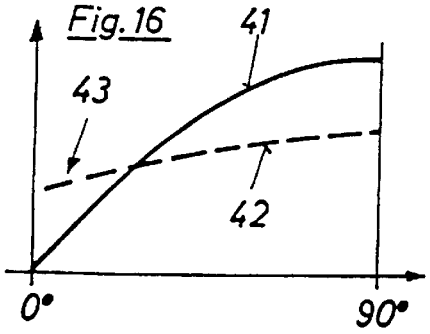

While the swing-action seat of FIG. 9 is pressed upwards by an adjusting force applied by a spring, it is the case with the swing-action bed 40 of FIG. 15, as is often installed in lorries, that the gravitational force seeks, as adjusting force along the characteristic curve 41 of FIG. 16, to allow said bed, once its locking mechanism has been released, to drop downwards out of the swung-up position into the sleeping position, which is depicted by dashed lines and in which the bed is retained by straps 40'. In order to prevent the bed from dropping down too quickly without braking, the progression of the braking force of the pivot brake 12, which is installed in the hinges 1 of the swing-action bed 40, is, in turn, selected in accordance with the characteristic curve 42 such that some of the pivoting work is used up by the braking work. The fact that the braking force exceeds the adjusting force again in the initial region 43 of the pivoting distance, approximately 90° from here, has the advantage that the swing-action bed, once pivoted up and locked, does not rattle in its locking mechanism under the action of travelling motion.

Figure 17:
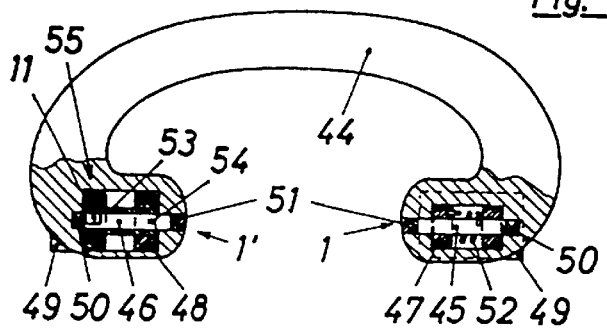
FIGS. 17 and 18 show a handle, for example, in a motor vehicle with sectioned bearing units together with a force/pivot-angle diagram of said handle.
Figure 18:
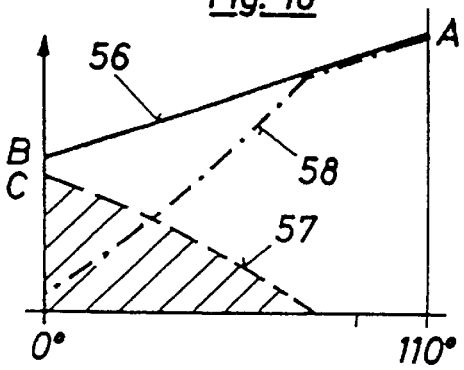

FIG. 17 illustrates all the details, by way of example, of the embodiment of a pivot brake using the example of a handle 44 as is often arranged on the edge of the roof in the interior of passenger vehicles. Said handles are mounted pivotably, with the result that they can be swung downwards, as required, from a rest position, in which they butt against the vehicle ceiling. The force of an installed spring means that, when they are released, the handles are pivoted back up into the rest position and retained in this rest position.

As can be seen from FIG. 17, the handle 44 is mounted by means of two hinges 1 and 1' at its two ends. Said hinges comprise a shaft, which is connected to the handle 44 in a rotationally fixed manner and is in the form of bearing pins 45 and 46, and a hub in the form of in each case two bearing eyelets 47 and 48, respectively, which are each seated on bearing plates 49 by means of which the handle can be fastened on the body of a motor vehicle. At one end, the bearing pins 45, 46 have a polygonal stub 50 by means of which they engage in corresponding recesses of the handle and are thus connected to the latter in a rotationally fixed manner. When the handle is installed, the bearing pins 45, 46 are inserted into the handle through an opening, which is then closed off by means of a stopper 51 being pressed in.

In the right-hand hinge 1 in FIG. 17, a torsion spring 52 encloses the bearing pin 45 and engages in one of the bearing eyelets 47 by way of one end and in the bearing pin 45 by way of its other end. The torsion spring 52 is prestressed such that it presses the handle 44 upwards into the position depicted.

In the left-hand hinge 1' in FIG. 17, a tube 53 is fastened in the bearing eyelets 48 of said hinge, it being possible for the bearing pin 46 to be rotated in the tube. Said tube 53 can be injected into the bearing eyelets 48 during production of the bearing plate 49, which takes place preferably by injection moulding. Since the angle position of the tube 53 in the bearing eyelets 48 is important for the functionally correct action of the wedge-surface pairings, the tube 53 has a groove 54 by way of which it can be positioned in the injection mould, and secured and injected therein, in a certain angle position.

In a region 55, the tube 53 and the bearing pin 46 of the hinge 1' have coordinated wedge-surface pairings 11. The action of the latter is illustrated in the force/angle-of-rotational diagram of FIG. 18 over the pivot angle of 110° of the handle 44. The adjusting force of the spring 52 is assumed to correspond to the progression of the characteristic curve 56, and that of the braking force of the pivot brake is assumed to correspond to the characteristic curve 57. In the assumed pivoting range of the handle, the adjusting force of the spring 52 is assumed to decrease from the value A to the value B. The wedge-surface pairings 11 are advantageously dimensioned and positioned such that they allow the handle 44 first of all a non-inhibited pivoting movement of a pivot angle of, for example, 35°. This is followed by the increasing frictional force of the wedge-surface pairings 11 setting in in accordance with the characteristic curve 57, said frictional force counteracting the force of the spring 52 and allowing the handle to be subjected merely to the difference between the two forces, said difference being indicated by the characteristic curve 58. This difference decreases rapidly, with the result that the handle is pivoted increasingly more slowly and pivots back into its rest position at 0° merely with a low end force, without striking forcibly against its abutment.

It can be seen that the frictional or braking force of the wedge-surface pairings 11 should be calculated such that they do not exceed the force of the spring 52, in order that there is always spring force which presses the handle reliably back into the rest position. The braking force of the wedge-surface pairings should thus not increase beyond the value C, which is below the value B. In the rest position, the braking force of the wedge-surface pairings also has the effect of retaining the handle in this rest position. The braking force C can safely exceed the spring force B when the handle is released, for example, in the pivoted-out position and swings back into the rest position.

It can also be seen that, for the work which is to be performed by the wedge-surface pairings 11 and is under the characteristic curve 57 of this braking force, a proportion of 20% to 25% of the work which is performed by the spring 52 and is under the characteristic curve 56 of the spring is usually sufficient in order to achieve the sought-after degree of damping.

Figure 19:
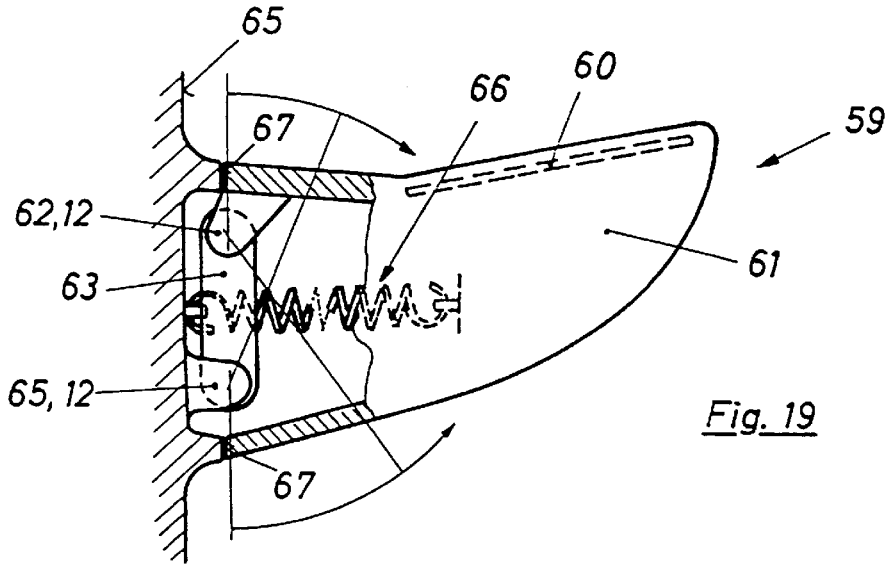
FIG. 19 shows the plan view of an exterior rearview mirror, which is partially broken away, with pivot brakes.

FIG. 19 shows an application case in which two pivot brakes are used in each of two interacting hinges. This figure concerns an exterior rearview mirror 59 of a motor vehicle which, when subjected to the action of correspondingly high forces, is intended to be able to yield in order that injury can be avoided.

For this purpose, the housing 61, which contains the mirror 60, is mounted in a hinge 62 which can be pivoted via a coupling element 63, for its part, in a further hinge 65, which is fixed on the body 64 of the vehicle. The housing 61 is drawn against bearing surfaces 67 by means of a spring 66 articulated on it and on the body 64.

If the housing 61 is subjected, for example, to the action of an adjusting force which acts from the front and exceeds the moment applied by the spring 66, the housing yields rearwards to this force by pivoting about the hinge 62. Correspondingly, the housing 61 and the coupling element 63 yield forwards, by pivoting about the hinge 65, as a result of an adjusting force which acts in the housing from the rear. Once the adjusting force is eliminated, the housing 61 snaps back into its initial position again under the action of the spring 66.

In order to prevent this snapping-back operation, in the case of which it is possible to get something trapped in the quickly and forcibly closing gap between the housing 61 and one of the bearings surfaces 67, the two hinges 62 and 65 are provided with hinge brakes 12 by means of which said snapping-back operation is slowed down, decelerated and damped.

In order that the housing returns reliably into the set starting position, the intention is for the braking force of the pivot brakes not to exceed, in any region of the pivot angle, the moment applied by the spring 66.

As can be seen from the above descriptions, it is not only the slope and the arc length of the wedge surfaces but also the correct angle position of the wedge-surface pairings in relation to the pivoting range which plays a decisive role in the correct selection of the progression of the braking force of a pivot brake according to the invention. In order for it to be possible to adjust this angle position accurately and straightforwardly, the devices which are described hereinbelow with reference to FIGS. 20 and 21 are provided.

The hinges 1 have a first hinge plate 68 and a second hinge plate 69, which are connected to one another by a hinge pin 70. By way of the hinge plates 68 and 69, the hinges 1 are fastened, on the one hand, on a fixed structural part and, on the other hand, on a pivotable structural part by means of screws which engage through holes 71. The hinge pins 70 rotate in a first axial region 72 in the hinge plates 68 or 69 and are fastened in a second axial region 73 in the respectively other hinge plate 69 or 68.

The first axial region 72 of the hinge pin 70 and the associated bearing bore of the hinge plates 68, 69 have the wedge-surface pairings 11 which have already been described. A nut 74, which can be screwed onto that end region of the hinge pin 70 which is in the form of a thread, or a clamping ring 75 interact with a collar 76 in order to secure the hinge pins in the hinge plates.

Figure 20:
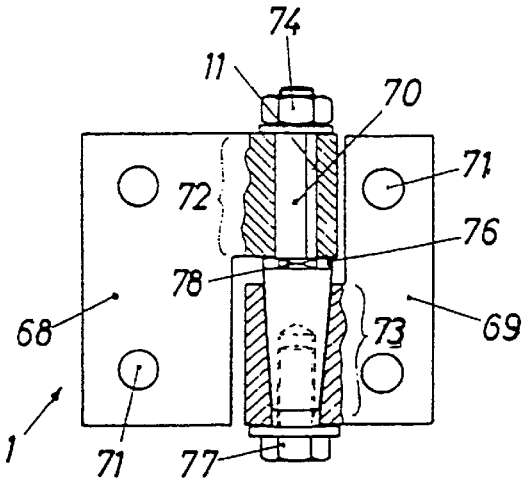
FIGS. 20 and 21 show two partially sectioned views of hinges having pivot brakes.
Figure 21:
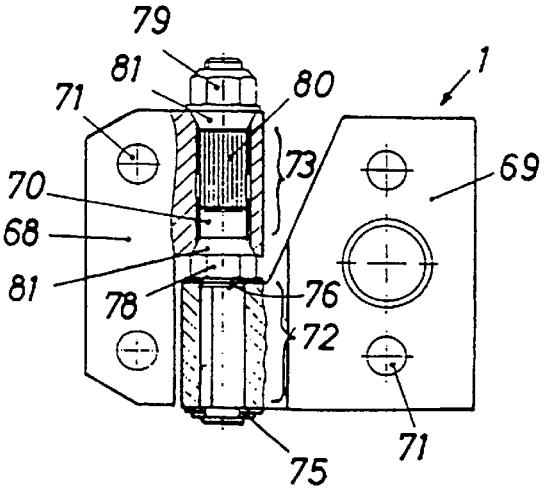

In the first embodiment of the invention according to FIG. 20, the profiles of the second axial regions 73 of the hinge pin 70 and the bearing bore of the hinge plate 69 are of conical design. The cone surfaces may be pressed one into the other by means of a fastening screw 77, with the result that the hinge pin 70 and the hinge plate 69 are connected to one another in a rotationally fixed manner with a force fit. The cone angle, which for the sake of clarity is depicted in a vastly exaggerated manner in the drawing, may be small, with the result that, under high surface pressure, it is possible to achieve a high retaining force against rotation.

When the moveable structural part is pivoted, the hinge pin 70 is rotated in the hinge plate 68. At the same time, the wedge surfaces of the wedge surface pairings 11 slide on one another and progressively increase the frictional locking between the parts. As a result, the pivoting movement is progressively inhibited. The extent of this inhibiting action can be changed by virtue of the hinge pin 70 in the hinge plate 69 being rotated into a different starting position and can be readjusted in the event of wear.

For this purpose, release of the screw 77 releases the conical fit in the axial region 73 and the hinge pin 70 is rotated by a tool, which engages on a wrench-engagement surface 78 on the circumference of the collar 76, to such an extent that the intended inhibiting action is achieved. In order to secure this new position of the hinge pin 70, tightening the fastening screw 77 causes the components of the conical fit to be pressed on into the other again in their mutual position.

In the embodiment of FIG. 21, the hinge pin 70 is secured in the hinge plate 68 by means of a nut 79 which can be screwed onto a thread at the top end of the hinge pin 70. In order to secure the angle position between the hinge plate 68 and hinge pin 70, use is made here of a profiling in the form of a toothing arrangement 80 on the second axial region 73 of the hinge pin and in the bore of the hinge plate. This interengaging toothing arrangement 80 may be designed as a serration.

In order to change the rotary position of the hinge pin 70 in the hinge plate 68, the hinge plate is drawn off from the hinge pin once the nut 79 has been released, i.e. the structural part mounted by means of the hinge 1 is removed. The hinge pin 70 may then be rotated by a tool acting on the wrench-engagement surface 78. Once this has taken place, the hinge plate 68 is inserted onto hinge pin 70 again, the toothing arrangement 80 sliding one into the other in a different position. Finally, the hinge plate 68 is fastened on the hinge pin 70 again by means of the nut 79.

Since the toothing arrangements 80 have to have an amount of joining play, the hinge pin 70 and the bore of the hinge plate 68 are provided, at least on one side, with conical extensions 81 by means of which the parts can be braced with respect to one another when the nut 79 is tightened and are prevented from rattling. The nut 79 may have a conical extension 81 on the opposite side.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Hinge for the pivotable mounting of a structural part on which there acts an adjusting force which causes said structural part to pivot comprising:

a pivot brake which inhibits said pivoting and is in the form of interacting cylinder wedge surfaces on a hinge pin and on at least one hinge plate operatively arranged with the structural part;

wherein the progression of a braking force of the pivot brake is adapted to the progression of the adjusting force acting on the structural part over a pivot angle to the effect that the braking force, which opposes the adjusting force, is smaller than the adjusting force at least over a considerable part of the pivot angle; and wherein the pivot brake comprises two pairs of interacting cylinder-wedge surfaces which take effect one after the other.

2. Hinge according to claim 1, wherein the braking force of the pivot brake exceeds the adjusting force acting on the structural part in at least one region located at a start or at an end of the pivot angle of the structural part.

3. Hinge according to claim 1, wherein the pivot brake (12) does not set any opposing force against the adjusting force, acting on the structural part over at least a subregion of the pivot angle.

4. Hinge according to claim 1, wherein at least 20% of the adjusting work corresponding to adjusting force times pivoting distance is absorbed as braking work corresponding to braking force times pivoting distance and converted into heat energy by means of the pivot brake.

5. Hinge according to claim 1, wherein the two wedge-surface pairs are arranged in a rotary gap of a hinge.

6. Hinge according to claim 1, wherein the two wedge-surface pairs slope upwards in opposite directions and with opposite directions of slope starting from a joining position.

7. Hinge according to claim 6, wherein the hinge pin has means for adjusting its angle position.

8. Hinge according to claim 1, wherein the two wedge-surface pairs slope upwards one after the other with the same direction of slope starting from a joining position.

9. Hinge according to claim 1, wherein the pivot brake has two to six wedge-surface pairs.

10. Hinge according to claim 9, wherein the hinge pin has means for adjusting its angle position.

11. Hinge according to claim 1, wherein the hinge pin has means for adjusting its angle position.

12. Hinge according to claim 11, wherein the hinge pin in a second axial region, and the hinge-pin-securing hinge plate have conical fitting surfaces which can be pressed one inside the other.

13. Hinge according to claim 11, wherein the hinge pin, in a second axial region, and the hinge-pin-securing hinge plate have fitting surfaces with interengaging toothing arrangements.

14. Hinge according to claim 1, wherein the hinge pin has means for adjusting its angle position.

15. Hinge according to claim 1, wherein the structural part is a passenger vehicle hood.

16. Hinge according to claim 1, wherein the structural part is a passenger vehicle trunk lid.

17. Hinge according to claim 1, wherein the structural part is a passenger vehicle stowage compartment cover.

18. Hinge according to claim 1, wherein the structural part is a passenger vehicle seat.

19. Hinge according to claim 1, wherein the structural part is a passenger vehicle bed.

20. Hinge according to claim 1, wherein the structural part is a passenger vehicle support handle.

21. Hinge according to claim 1, wherein the structural part is a vehicle mirror assembly.

22. Hinge assembly for pivotably mounting a structural part which in use is acted on by an adjusting force to pivot over a pivot angle, comprising:

a pair of hinge plates, one of said hinge plates being connected to move with the structural part, and a hinge pin pivotably connecting the hinge plates, wherein the hinge pin and at least one of the hinge plates are provided with interacting inclined surfaces which act as a pivot brake controlling resistance to pivotal movement of the structural part as a function of a pivotal position of the structural part, said inclined surfaces being configured to apply a resistance force opposing the adjusting force which is smaller than the adjusting force at least over a considerable portion of the pivot angle, wherein the pivot brake comprises two pairs of interacting cylinder-wedge surfaces which take effect one after the other.

23. Hinge assembly according to claim 22, wherein the structural part is a passenger motor vehicle part.

* * * * *